United States Patent [19]

Colby

[11] Patent Number: 4,600,134

[45] Date of Patent: Jul. 15, 1986

[54] DUAL CARRYING POUCH

[76] Inventor: Jeffrey S. Colby, 5985 Glencoe Rd., Excelsior, Minn. 55331

[21] Appl. No.: 671,788

[22] Filed: Nov. 15, 1984

[51] Int. Cl.[4] ..... A45F 3/04

[52] U.S. Cl. ..... 224/260; 224/264

[58] Field of Search ..... 224/260, 215, 216, 151, 224/209, 264, 204; 150/52 J

[56] References Cited

U.S. PATENT DOCUMENTS

| | | | |
|---|---|---|---|
| 469,444 | 2/1892 | Frazier | 224/216 X |
| 765,893 | 7/1904 | Howard et al. . | |
| 840,332 | 1/1907 | Howard et al. | 224/216 |
| 1,207,154 | 12/1916 | Fox | 224/260 X |
| 1,290,827 | 1/1919 | Yergason | 224/215 X |
| 1,511,259 | 10/1924 | Braden | 224/264 X |
| 1,601,624 | 9/1926 | Houghton | 224/215 X |
| 1,727,873 | 9/1929 | Farmer, Jr. | 224/260 |
| 1,871,223 | 8/1932 | Reese | 224/204 |
| 1,884,328 | 10/1932 | Sperling | 224/215 X |
| 3,181,752 | 5/1965 | Seltzer et al. . | |
| 4,096,978 | 6/1978 | Noice | 224/215 |
| 4,260,004 | 4/1981 | Domke | 150/52 J X |
| 4,327,852 | 5/1982 | Gibson . | |
| 4,403,638 | 9/1983 | Baum | 150/52 J |

*Primary Examiner*—Stephen Marcus
*Assistant Examiner*—Robert Petrik
*Attorney, Agent, or Firm*—Hugh D. Jaeger

[57] ABSTRACT

Dual carrying pouch for carriage of mail, packages, magazines, newspapers, or the like, consisting of two opposing pouches or bags suspended by belts, straps, or harnesses, the harnesses including shoulder straps and waist belts. Padded shoulder straps are adjustable vertically in the forward frontal area, as well as in the rear back area, by adjustable buckles, common straps or webbing adjusters, and provides for lateral adjustment of the forward lower ends of the shoulder straps through a pectoral belt, buckle adjuster, and shock snubber. Adjustable hip pads secure to the dual carrying pouches and include a front tensioning belt, front adjustable buckle, and a rear back tensioning belt and adjuster. Shoulder harnesses and waist belts act together or independently of each other to provide for load distributions equally upon user's shoulders and hips or similarly so as to distribute load weights solely upon user's shoulders or hips, as desired, by adjustment of the belts and adjuster buckles. Either males or females can use the pouch based on its extreme range of adjustability and load shifting capabilities, which also includes a pectoral adjuster belt and shock snubber which allow flexibility and adjustment of the shoulder straps about the chest area of the user regardless of sex. Pouch adjuster straps on the forward and rear portions of the pouches allow for positioning of pouch cargo laterally either inwardly or outwardly for proper balance of pouches so as to allow for proper load distribution across the body of said user.

2 Claims, 4 Drawing Figures

DUAL CARRYING POUCH

BACKGROUND OF THE INVENTION

1. Field of the Invention

The present invention pertains to a dual pouch carrying bag, and more importantly, pertains to a infinitely adjustable harness and belt system, with carrying pouches affixed to the same for carriage of mail, packages, or other goods upon the human body. The pouch offers multiple options of supporting adjustments for optimum comfort, maximum weight carrying capability, and minimum strain upon various body members.

2. Description of Prior Art

Prior art carrying pouches and bags using straps of leather have failed to be comfortable in shoulder areas and in waist areas due to usage of leather strapping which was of insufficient width to provide comfortable support for the load upon the body of the user. Support on or about the waist area, for purposes of load carrying ability, has not been a prime consideration wherein any waist area unpadded belts were used for circumferentially spacing the bags, but not supporting the bags about the waist of the person, often times a U.S. Mail Carrier.

Adjustability in prior art bags or pouches has been usually of that type found on a common belt buckle, that is to say a buckle assembly using a stiff piece of wire rod to engage a hole punched in the leather providing only certain finite adjustments, adjustment of which is limited by the number of existing holes. The adjustment of these devices, some of which include overly intricate harnesses, while under heavy cargo loads, is cumbersome at best, as well as time consuming, if any adjustment at all was found in the device.

Prior art systems mostly taught suspension of loads from the shoulder areas of the user, providing only a minimum of adjustment, and have failed to allow for loading of the spine, waist area, the shoulder area, or all in combination thereof. Shifting of pouch cargo, so as to provide for proper balance and distribution, have not been provided.

One representative prior art patent is U.S. Pat. No. 765,893, Howard et al., issued July 26, 1984, which discloses index case equipment for delivery of mail in FIG. 1. The support system does not provide adjustability or carrying of weight adjustably about one's waist.

The present invention overcomes the disadvantages of the prior art by providing a dual pouch carrying device which incorporates padded shoulder and waist belts, constructed of man-made, high-tech materials; readily and quickly adjustable combination buckles; infinitely adjustable adjusters; and a simple network of support members on and about the waist and shoulders, wherein adjustments are provided for, which allows for proper load bearing adjustments with respect to the shoulders, the spine, the hips, and the chest of the user, or any combination thereof, regardless of sex.

SUMMARY OF THE INVENTION

The general purpose of the present invention is to provide a dual carrying pouch which is readily adaptable to any individual size, and that provides for proper distribution of load on and about any user's torso.

According to one embodiment of the present invention, there is provided a dual carrying pouch including a pair of shoulder straps, the back of which form a junction to which support back straps and adjusters are secured, the lower ends of which secure to reinforcing bands at the rear portion of the opposing pouches; lower frontal shoulder strap junction pads and adjustable buckles secured to dual opposing pouches via front straps and the forward portion of the longitudinal reinforcement bands; a pectoral belt flanked on one side by an adjuster buckle and on the other side a shock snubber; a front and rear waist belt secured between dual carrying pouches, including left and right hip pads and front waist adjuster buckle; opposing pouches each of which include pouch covers, pouch straps, and pouch strap adjusters; and, pouch compartments including velcro fasteners for the pouch covers.

One significant aspect and feature of the present invention is a dual carrying pouch which provides for large wide padded shoulder, and waist or hip pads allowing for minimum chafe and fatigue to the individual.

Another significant aspect and feature of the present invention is a dual carrying pouch which provides for quick release and infinite adjustment of each and every strap, belt, and the like.

A further significant aspect and feature of the present invention is a dual carrying pouch which provides for the ability to adjust the overall load to rest upon the shoulders, or, more importantly, the hips, or upon the shoulders and the hips together, acting each in partial support or in unison for varying the load upon the spinal, shoulder, or pelvic regions of the body as required.

Another significant aspect and feature of the present invention is a dual carrying pouch which provides for the shifting of pouch cargo, either inwardly or outwardly, for purposes of proper lateral balance between opposing sides of an individual.

Yet another significant aspect and feature of the present invention is a dual carrying pouch which provides for compatibility to the sex of the user by means of adjustment laterally across the pectoral area of the forward shoulder strap portion, which provides as well for breathing movement through use of a elastic shock snubber, thus allowing for controlled lateral tension between the shoulder straps.

Having thus described the invention, it is a principal object hereof to provide a dual carrying pouch for mail or the like.

An object of the present invention is to provide a dual carrying pouch which is readily adjustable to any size individual, irrespective of sex.

Another object of the invention is to provide a dual carrying pouch which provides for maximum well being and variability of support upon the shoulders, hips, chest, and spinal area of the mobile pedestrian such as mail carrier, newspaper deliverer, or similarly employed person.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts through the figures thereof and wherein.

DESCRIPTION OF THE PREFERRED EMBODIMENTS

Figure 1:
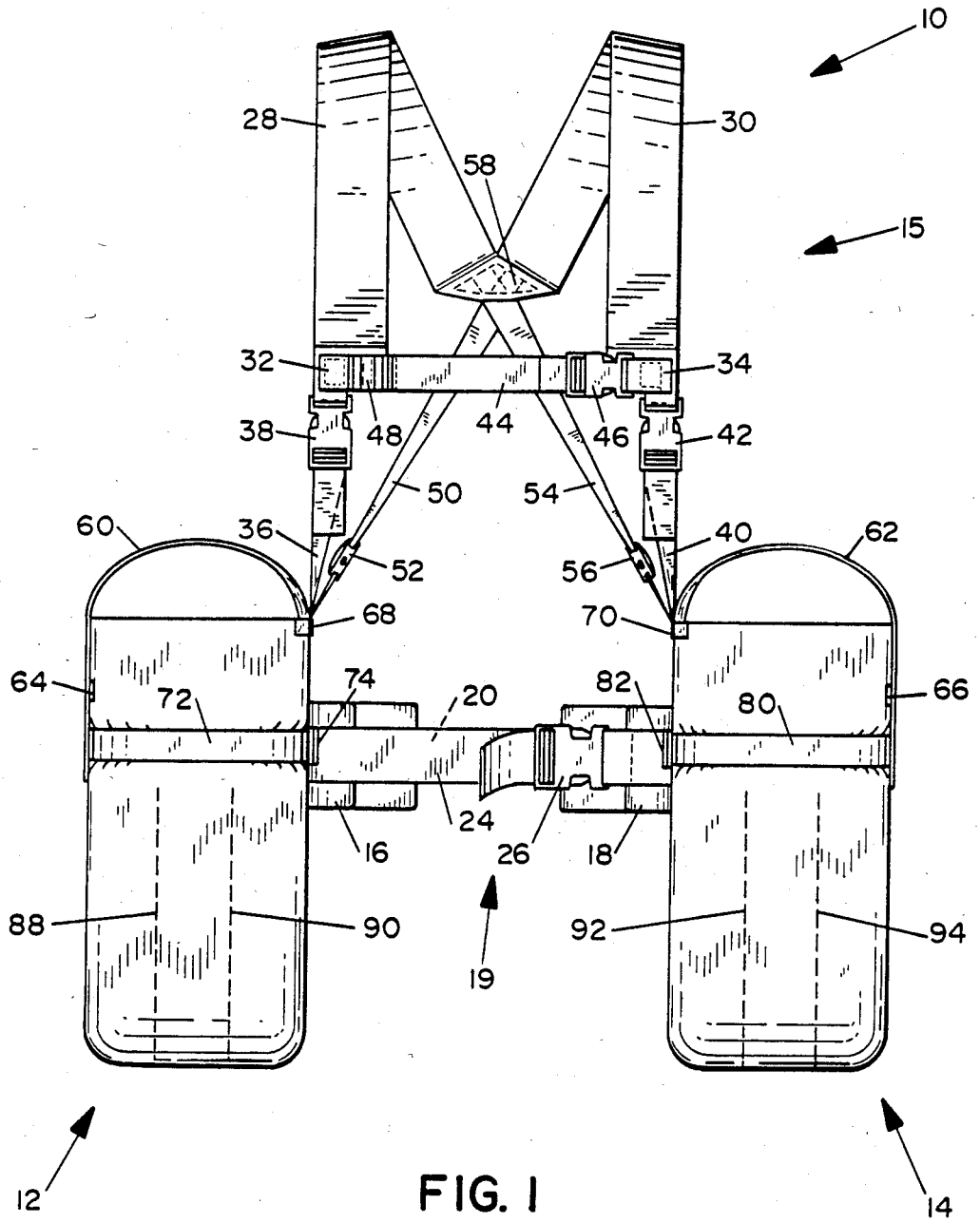
FIG. 1 illustrates a front plan view of the carrying pouch, the present invention.

FIG. 1, which illustrates a front view of the present invention, shows a dual carrying pouch 10, including opposing right pouch 12 and a like left pouch 14 while secured together at a waist band assembly 19 at a mid portion of each pouch by a front belt 24, a back waist belt 20, as well as at a shoulder harness assembly 15, and by padded shoulder straps 28 and 30 which serve as support, along with other straps, as later described, for pouches 10 and 12. The pouches hold mail such as letters, flats, magazines, etc. Padded shoulder straps 28 and 30 converge vertically downwardly to the rear shoulder strap junction 58 which serves as a common point for joining of right back strap 50, left back strap 54, and shoulder straps 28 and 30. Right and left back straps 50 and 54 secure to right and left longitudinal reinforced webbing bands 68 and 70, respectively, through right and left back strap adjusters 52 and 56, respectively, providing for vertical adjustment of the rear and rear edge portions of pouches 12 and 14. Reinforced webbing bands 68 and 70 run longitudinally along the top innermost edge of pouches 12 and 14 serving as a medium of suport between the shoulder harness assembly 15 and pouches 12 and 14. Right and left shoulder straps 28 and 30 descend downwardly in the frontal portion to right and left forward junction shoulder strap junction pads 32 and 34, respectively. Junction pad 32 is a common point for the joining of right shoulder strap 28, right front strap adjustment buckle 38, and the pectoral belt shock snubber 48 end of a horizontal pectoral belt 44. In a like manner, the left forward shoulder strap junction pad 34 is a common point for the joining of, by heavy stitiching or other suitable means, left shoulder strap 30, right front strap adjustment buckle 42, and the pectoral belt adjustable buckle 46. The right front strap 36 secures between the right front strap adjuster buckle 38 and the forward portion of the right longitudinal reinforced band 68 at a forward and forward edge of the pouch 12. In a like manner, the left front strap 40 secures between the left front strap adjuster buckle 42 and the forward portion of the left longitudinal reinforced bad 70 at a forward and forward edge of the pouch 14. Right and left front strap adjustment buckles 38 and 42 provide for vertical adjustment of the forward portions of the pouch 12 and 14 with respect to the user of said invention. Pectoral belt 44, including pectoral shock snubber 48 and the pectoral adjustment buckle 46, provide for adjustment laterally of the dimension between shoulder strap junction pads 32 and 34, as well as the lower forward extremities of shoulder straps 28 and 30, along with the positioning of front straps 36 and 40, all for insuring proper fit of the shoulder straps 28 and 30 to the pectoral regions of either a male or female user.

Padded waist band assembly 19 positions between pouches 12 and 14, and below shoulder harness 15. Right and left hip pads 16 and 18, respectively, secure by heavy stitching, rivits, or other suitable securing methods, to the upper mid level of the pouches 12 and 14. Secured by heavy stitching to the forward portion of right padded hip pad 16 is the front waist belt 24, the other end of which secures to a portion at the front waist belt adjustment buckle 26. The forward left padded hip pad 18 secures by common webbing to the other portion of adjustment buckle 26. Front waist belt 24 with the front waist belt adjustment buckle 26 provides for tensioning of the waist belt assembly 19 around and about the forward waist and abdominal area of the user. The back waist belt 20 secures by heavy stitching to the rearward portion of right hip pad 16 on one end, and to the rearward portion of left hip pad 18 through back waist belt adjuster 22, which secures by heavy stitching such as nylon square and cross stitching. Back waist belt 20 and back waist belt adjuster 22 serve to tension the waist belt 20 and rearward portions of hip pads 16 and 18 to the waist of the user, as well as above and partially on the upper portion of the buttocks area. The waist band assembly 19, as a unit as previously described in detail, functions as one integral unit to encompass the waist of the user, thus providing full or partial support of the pouches 12 and 14, along with the shoulder harness 15, which provides full or partial support of pouches 12 and 14, either acting by itself of jointly with the other straps as described.

Figure 2:
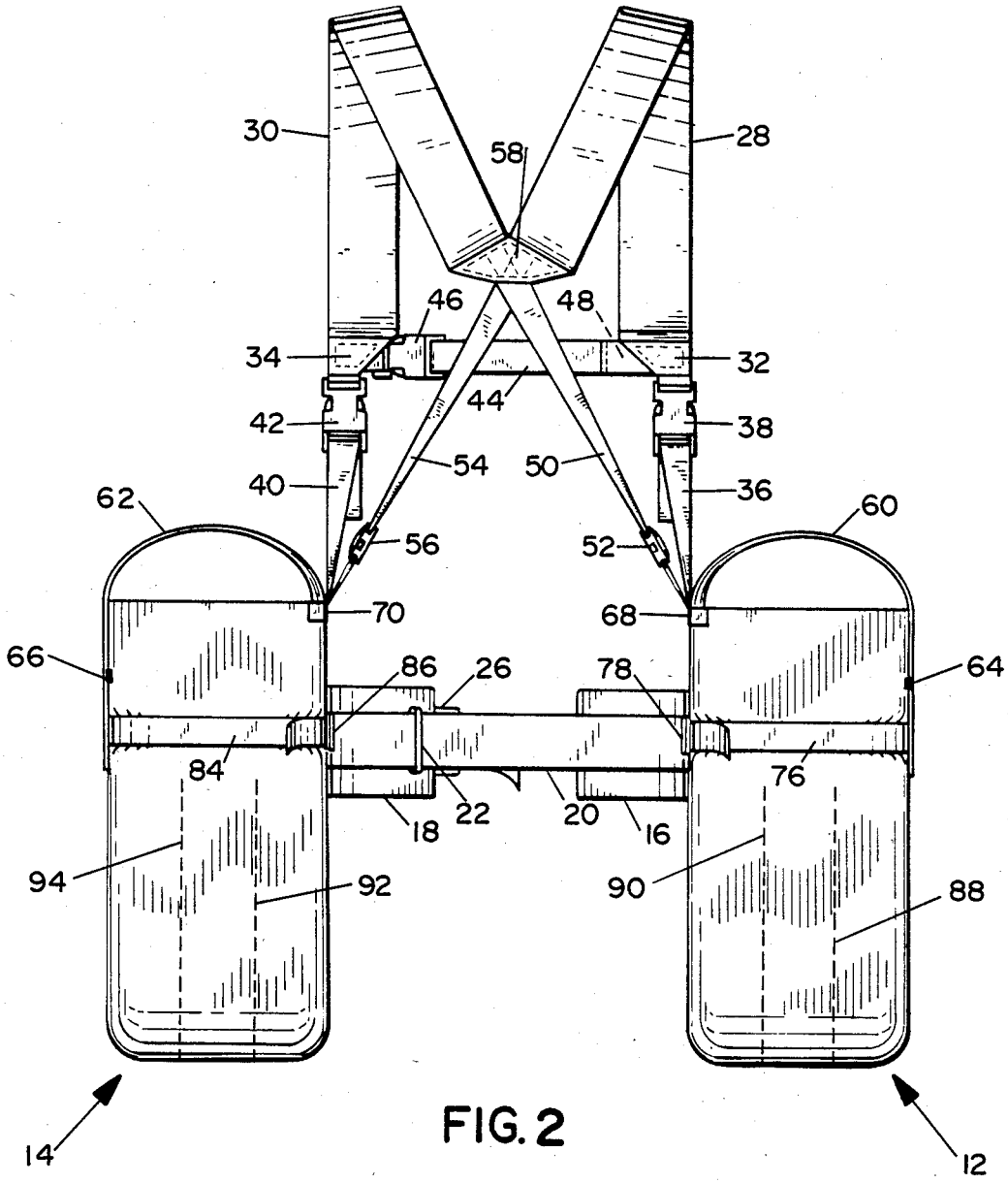
FIG. 2 illustrates a back view of the dual carrying pouch.

Opposing pouches 12 and 14 are fashioned of heavy nylon, dacron, high technology man-made materials, or the like, and include flap covers 60 and 62, respectively, and which may be somewhat loose and floppy in shape, ranging to semi floppy, to conform to articles being carried in the pouch. Flap covers 60 and 62 secure to the pouches 12 and 14, and pivot upwardly and outwardly along longitudinal reinforced bands 70 and 68. Velcro strips 64 and 66, or other fastening devices secure the flap covers 60 and 62 to pouches 12 and 14 for quick and easy access to the pouches interiors, which include separation partitions 88–94, the pocket size, of which, may be adjusted through the use of velcro strips. Right forward pouch strap 72, right forward pouch strap adjuster 74, right back pouch strap 76, and right back pouch strap adjuster 78, as illustrated in FIG. 1 and FIG. 2, all adjust to accommodate the size and weight of goods carried within pouch 12, as do like components in pouch 14, thus keeping the cargo weight adjusted properly as to effect a proper balance between pouches 12 and 14 so as not to subject the user to undue bodily strain due to improper load moment. Left forward pouch strap 80, left forward pouch strap adjuster 82, left back pouch strap 84, and left back pouch strap adjuster 86, as illustrated in FIG. 2, function in a like manner with regards to pouch 14 as those just previously described for like and corresponding items of pouch 12.

FIG. 2 illustrates a rear view of the dual carrying pouch. All other numerals correspond to those elements previously described. The back straps 50 and 54 and shoulder straps 28 and 30 are illustrated in the particular configuration as described.

Figure 3:
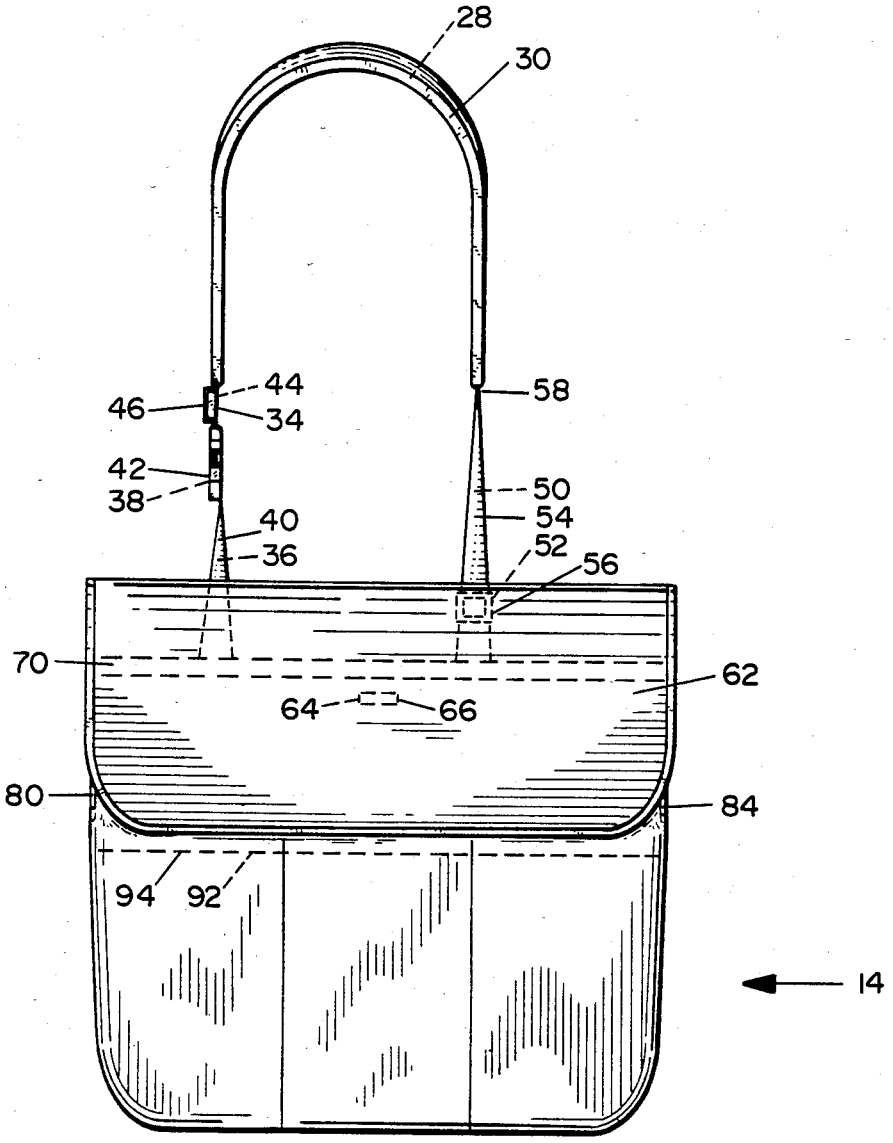
FIG. 3 illustrates a left side view of the dual carrying pouch, the right side being a mirror image thereof; and, FIG. 4 illustrates a top overhead view of the dual carrying pouch.

FIG. 3 illustrates a view of the left side of the dual carrying pouch. Illustrated in dashed lines is the attachment of the left front strap 40, left rear strap 54, and left back strap adjuster 56 to the left longitudinal, reinforced band 70. Like and associated components, as viewed from the right side, would be in a like and similar position in a mirror image like fashion. All other numerals correspond to those elements previously described.

Figure 4:
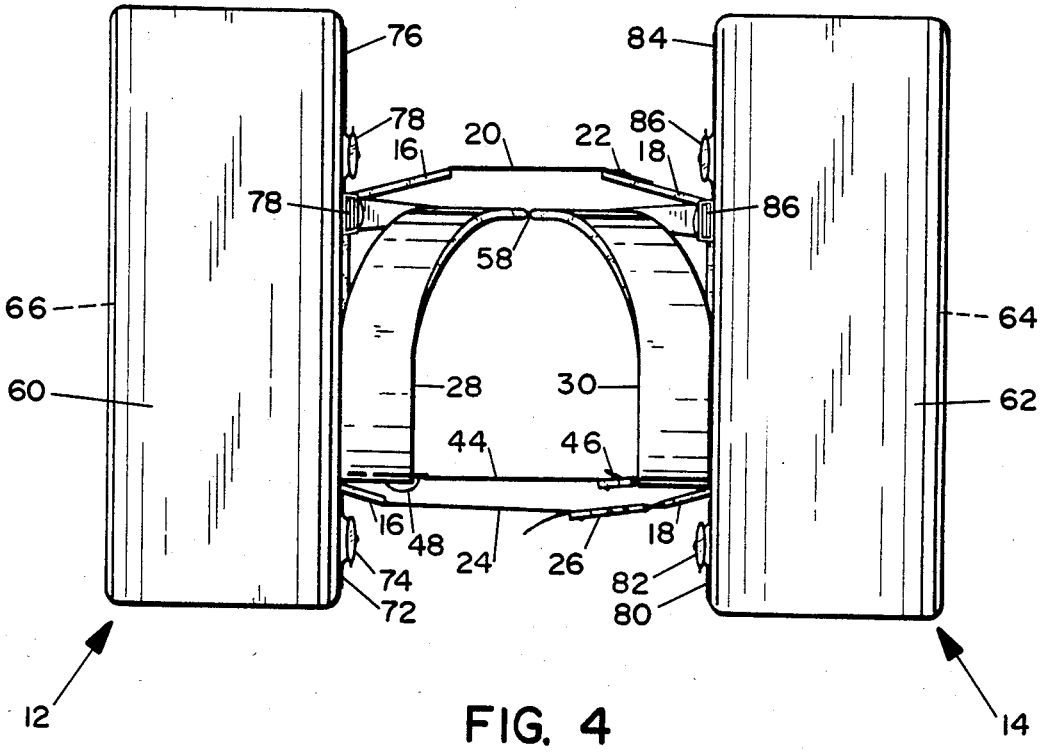

FIG. 4 illustrates a top overhead view of the dual carrying pouch. Shown in particular are adjusters 74, 78, 82, and 86; pouch straps 72, 76, 80, and 84; as well as hip pads 16 and 18 with associated connecting buckles.

All other numerals correspond to those elements previously described.

MODE OF OPERATION

The straps 28 and 30 of the dual carrying pouch 10 are worn over the shoulders of an individual. Right and left back strap adjusters 52 and 56 adjust the rearward portion of pouches 12 and 14 vertically by adjusting the length of back straps 50 and 52. Buckle adjusters 38 and 42 latch together at the front portion of shoulder straps 28 and 30 providing for the securement of the shoulder strap 28 and 30 to front straps 36 and 38, and for vertical positioning of the front portion of pouches 12 and 14 through front straps 36 and 38, which attach to pouches 12 and 14 at longitudinal reinforcement bands 68 and 70.

The individual then secures the pectoral belt 44 and elastic snubber 48 by mating the two halves of pectoral adjuster buckle 46 and adjusting the strap for his or her comfort needs. The rear adjuster buckle 22 of rear waist belt 20 is then adjusted to the individual's size, followed then by the mating of both halves of the front waist belt adjuster buckle 26 and tightening of front waist belt 24 to one's pelvic regions through action of adjuster buckle 26. This allows for distribution of the pouch weight upon the shoulders, hips, spine, and in part, the pectoral area of the user. When the user requires distribution of weight to be placed solely upon the shoulders, it may be necessary to either quickly release the mating halves of the front waist adjuster buckle 26 using the quick release function, or to simply slacken or loosen the tension of front waist belt 24 by inhaling and then adjusting the front waist adjuster buckle 26. If the load is to be moved laterally across the shoulders, the tension of pectoral belt 44 may be adjusted by adjustment of pectoral adjuster 46. Conversely, to shift any cargo weight to the hips, right and left front adjuster buckles 38 and 42 are adjusted to loosen tension upon shoulder straps 28 and 30, right and left back straps 50 and 54, and front straps 36 and 40, shifting cargo weight to front and rear waist belts 24 and 20 and pads 16 and 18 and thus, the hips of the user. In addition to the aforementioned, pouch straps 72, 76, 80, and 84 with pouch strap adjusters 74, 78, 82, and 86, respectively, loosen or tighten outwardly or inwardly, preferably inwardly, to adjust the contents for proper balance, and security of the contents from loss, as well as positive positioning within the pouch so as to not have the contents shifting with each step of the individual. Covers 60 and 62 aid to secure pouch contents, as well as to provide protection from the elements.

Various modifications can be made to the present invention without departing from the apparent scope thereof. For instance, any width of straps can be utilized. Likewise, different types of buckles or clasps can be utilized.

I claim:

1. Dual mail carrying pouches for utilization by a mail person delivering mail comprising:

a. like opposing mirror image mail pouches, each pouch including a rectangular bottom, four joined sides and an overlapping flap secured to a back side of said pouch for covering an opening of said pouch, said back side adjacent to said person's hip, and an inside of said flap and a front side of said pouch including a velcro fastening means;

b. waist belt including opposing hip pads, a back waist belt and belt strap adjuster connected between said hip pads, said back waist belt and belt strap adjuster encompassing said person's back area of said person's waist, and a front waist belt and adjustable strap buckle connected between said hip pads, each of said hip pads secured to a mid-portion of said back side of each of said pouches;

c. padded shoulder straps for resting on said person's shoulder, and joined at a rear shoulder strap crossing junction at a substantially mid-portion of said person's back, back straps and back strap adjusters joined at said crossing junction and connected above a rearward edge of said hip pd and along a top inner edge adjacent said person's side of of said pouches, and spaced inwardly along said top inner edge of each of said pouches from a rear vertical inner side seam of each of said pouches and front adjustable strap buckles connected between said shoulder straps and connected above a forward edge of said hip pad along a top edge of each of said pouches and spaced inwardly along said top inner edge of each of said pouches from a forward vertical inner side seam of each of said pouches whereby a geometrical relationship of connection of said back straps to each of said pouches is symmetrical to a geometrical relationship of connection of said front straps to each of said pouches; and, d. horizontal pectoral belt and an adjustable strap buckle connected at each junction of said shoulder straps and said front straps for resting about a front chest area of said person, whereby said mail person orientates said waist belt about their waist and positions the back straps about their back.

2. Pouches of claim 1 comprising end straps and strap adjusters at each end of each of said pouches for adjusting width of each of said pouches.

* * * * *